US005889261A

United States Patent [19]

Boardman

[11] Patent Number: 5,889,261

[45] Date of Patent: Mar. 30, 1999

[54] ELECTRICAL HEATING ELEMENTS

[75] Inventor: Jeffery Boardman, Warrington, United Kingdom

[73] Assignee: Deeman Product Development Limited, United Kingdom

[21] Appl. No.: 952,701

[22] PCT Filed: Jun. 7, 1996

[86] PCT No.: PCT/GB96/01351

§ 371 Date: Mar. 2, 1998

§ 102(e) Date: Mar. 2, 1998

[87] PCT Pub. No.: WO96/42184

PCT Pub. Date: Dec. 27, 1996

[30] Foreign Application Priority Data

Jun. 8, 1995 [GB] United Kingdom ..... 9511618

[51] Int. Cl.[6] ..... H05B 3/26; H05B 3/16

[52] U.S. Cl. ..... 219/543; 219/544; 338/307; 338/308; 338/309

[58] Field of Search ..... 219/543, 544, 219/457, 458, 459, 462, 464; 338/307, 308, 309; 392/407, 432, 433, 439

[56] References Cited

U.S. PATENT DOCUMENTS

| | | | |
|---|---|---|---|
| 3,978,316 | 8/1976 | Rose et al. | 219/543 |
| 4,357,526 | 11/1982 | Yamamoto et al. | 219/544 |
| 4,733,056 | 3/1988 | Kojima et al. | 219/543 |
| 4,785,150 | 11/1988 | Kojima et al. | 219/543 |
| 4,806,739 | 2/1989 | Kojima et al. | 219/543 |
| 4,952,903 | 8/1990 | Shibata et al. . | |
| 5,343,021 | 8/1994 | Sato et al. | 219/541 |
| 5,409,668 | 4/1995 | Bagley et al. | 219/543 |
| 5,498,855 | 3/1996 | Deevi et al. | 219/553 |
| 5,510,594 | 4/1996 | Mori et al. | 219/543 |
| 5,693,244 | 12/1997 | Pragt et al. | 219/441 |
| 5,753,893 | 5/1998 | Noda et al. | 219/548 |

FOREIGN PATENT DOCUMENTS

| | | |
|---|---|---|
| 0 302 589 A1 | 2/1989 | European Pat. Off. . |
| 1924202 | 11/1970 | Germany . |
| 3902484 A1 | 8/1989 | Germany . |
| WO 93/26138 | 12/1993 | WIPO . |

OTHER PUBLICATIONS

Search Report for International Application No. PCT/GB96/01351.

*Primary Examiner*—Mark H. Paschall
*Assistant Examiner*—Vinod D Patel
*Attorney, Agent, or Firm*—Anthony J. Casella; Gerald E. Hespos; Ludomir A. Budzyn

[57] ABSTRACT

An electrically resistive heating element for liquids and a method of fabricating same. The heating element comprises a substrate formed of an electrically insulating material or formed of an electrically conductive material provided with an electrically insulating coating, whereby in both cases the substrate presents an electrically non-conductive surface on at least one side. First and second laterally spaced contact areas are disposed over the electrically non-conductive surface and a thermally sprayed resistive oxide layer is applied to the electrically non-conductive surface and disposed over or under parts of the contact areas to enable an electric current to be passed through the resistive oxide layer via these first and second contact areas.

24 Claims, 4 Drawing Sheets

ELECTRICAL HEATING ELEMENTS

BACKGROUND OF THE INVENTION

The present invention relates to electrical heating elements and is concerned in particular with electrical resistance heating elements, principally for use in domestic appliances which involve the heating of liquids for food preparation such as kettles, heating jugs, coffee percolators and the like, and are of the type which do not intrude into the volume of liquid to be heated.

Conventional electrical liquid heating elements fall into two general categories.

The first category comprises sheathed elements consisting of a metal tube along the longitudinal axis of which is situated a conventional spiralled wire element and which in use an oxide as a means of providing dielectric (electrical insulation) between the tube and spiralled element. These sheathed elements are generally formed into some form of loop or spiral and are situated in the bottom of a vessel designated for liquid heating. As such they intrude into the volume of the liquid to be heated.

The latter elements are generally used for heating only one liquid, almost always water, as their convoluted shapes make them difficult to clean and completely remove traces of one type of liquid, should they be required to be used with a second.

In addition, the need to have an outer metal sheath to separate the spiralled wire element from the liquid and to have a dielectric oxide filling to separate metal sheath from element, have the result that such elements are of relatively large mass and low surface area, which combine to reduce their operational efficiency in heating liquids.

The second category of known elements comprises those which consist of a flat plate, forming the base of the heating vessel, through which heat flows from element to liquid. Such elements do not intrude into the volume of liquid to be heated.

This second category of element may be subdivided into two types, namely, those which simply use a conventional sheathed element fixed to the back of a flat plate, which then acts as a heat sink, and a second type which may be classified generally as thick film resistive heating elements.

The conventional approach to the formation of thick film elements is to utilise a metal substrate, onto the surfaces of which is applied a dielectric coating, usually a glaze. Screen printing techniques are employed to deposit an ink, consisting of a solvent and a mixture of metals and/or metal oxides, to one coated surface in the form of an element configuration comprising one or more printed circuit conductive tracks. The printed item is then fired to drive off the solvent and to melt the resistive particles of metal and/or oxide. A final dielectric coating, usually a glaze, is then applied to the screen printed element configuration to act as a protective layer.

Whilst these conventional sheathed and screen printed thick film elements may be very adequately used to heat liquids, they are subject to various constructional and operational disadvantages, some of which are listed as follows.

Because of the need to use an oxide dielectric filler in sheathed elements, the spiralled resistive wire which generates the heating effect is required to run at temperatures well in excess of those required to boil liquids. As a result, such elements are very prone to overheating and burn-out if operated without sufficient volume of surrounding liquid. In addition, their relatively high thermal mass detracts from their operational efficiency, as a large proportion of the heat initially generated goes directly into raising the temperature of the dielectric metal oxide and metal sheath and not into the liquid. This reduces the liquid heat-up rate.

In order to utilise sheathed elements in a flat plate configuration, it is necessary to combine then into another supporting metal plate, or layer. This plate, or layer, is usually of aluminium and serves as a heat sink, in effect providing a larger surface area over which the sheathed element may dissipate the heat energy being generated. The combination of aluminium plate, or layer, is then attached to the metal plate forming the base of the heating vessel. Whilst increasing the heat dissipating area of the sheathed element, this aluminium plate substantially increases the thermal mass of the system, which in turn detracts from the operational efficiency as it requires more energy initially to preheat it, before heat is transferred to the liquid.

The combination of sheathed element and aluminium layer, or plate, is also prone to operational failure where there is inadequate attachment of the sheathed tube to the aluminium plate. At any points of inadequate attachment, the heat being generated by the sheathed element cannot be fully dissipated to the aluminium plate acting as a heat sink. As a result, the temperature of the sheathed element at such points may rise to quite high levels. The localised thermal expansion associated with these "hot spots" may result in element failure or a progressive detachment of the element from the aluminium plate, which serves to exacerbate the overheating problem and accelerate element failure.

It is also known that there are constructional and operational problems associated with the existing screen printed thick film electrical resistance heating elements, which may be summarised as follows.

(a) Variations in the thickness or consistency of the conductive/resistive ink, as applied during the screen printing process, will result in unevenness in the final resistive element track. Such localised unevenness may result in the generation of "hot spots" within the elements track, leading to failure in operation.

(b) The presence of any defects or holes in the final protective glaze layer, such as those due to the presence of solvent traces, allow the resistive tracks to be locally oxidised, forming localised hot spots and leading to track failure.

(c) The screen printed elements are of a tracked form, usually spiralled. The tracks are discrete and usually are subdivided into parallel paths, and so configured as to cover the maximum amount of substrate area as possible. Despite this configuration, only a relatively small proportion of the substrate area is actually covered by the element in practice and in consequence the operating temperatures need to be well above the boiling points of the liquids being heated in order to achieve good heat transfer through the substrate.

(d) Another factor which deleteriously affects heat transfer from element to liquid is the combination of the metal substrate and the glazed insulating layer. Generally, the metal substrate which has been used is stainless steel, which has a poor coefficient of heat transfer when compared with say copper or aluminium.

The present invention seeks to overcome or substantially reduce the problems described above associated with the known configurations and manufacturing techniques.

SUMMARY OF THE INVENTION

In accordance with a first aspect of the present invention, there is provided an electrically resistive heating element for liquids, comprising a substrate formed of an electrically insulating material or formed of an electrically conductive material provided with an electrically insulating coating, whereby in both cases the substrate presents an electrically non-conductive surface on at least one side, first and second laterally spaced contact areas disposed over said electrically non-conductive surface and a thermally sprayed resistive oxide layer applied to at least part of said electrically non-conductive surface and disposed over or under at least parts of said contact areas to enable an electric current to be passed through the resistive oxide layer via said first and second contact areas.

By the expressions "thermally sprayed" and "thermal spraying process" used herein, we mean any process which utilises a heat source to deposit molten, or semi-molten, particles of metal, ceramics or combinations of metals and ceramics materials.

In one preferred embodiment, the substrate is discoidal and the resistive oxide layer is basically circular or annular but contains an angular discontinuity for accommodating a temperature limiting device.

Advantageously, in the latter embodiment, the first and second contact areas are disposed centrally and peripherally of the discoidal substrate, respectively, and include respective tongue portions projecting into said discontinuity in the resistive oxide layer for forming terminal areas to receive said temperature limiting device.

In one embodiment, the central contact area is circular and the peripheral contact area is annular, and the resistive oxide layer is applied to said electrically non-conductive surface so as to at least partially overlap said contact areas.

In another embodiment, the resistive oxide layer is annular and is applied directly to said electrically non-conductive surface, the central contact area being circular and overlapping the inner periphery of the annular resistive oxide layer, and the peripheral contact area being annular and overlapping the outer periphery of the annular resistive oxide layer.

In a still further embodiment the resistive oxide layer is circular and is applied directly to said electrically non-conductive surface, the central contact area is circular and is disposed over the resistive oxide layer and the peripheral contact area is annular and at least partially overlaps the outer periphery of the resistive oxide layer.

The invention also provides a method of forming an electrically resistive heating element for liquids, comprising the steps of:

(a) forming a substrate of an electrically insulating material or of an electrically conductive material provided with an electrically non-conductive coating, whereby, in each case, the substrate presents an electrically non-conductive surface on at least one side; and either (b) depositing first and second contact areas onto said electrically non-conductive surface; and (c) applying by a thermal spraying process as defined hereinbefore, a resistive oxide layer to the exposed part of said electrically non-conductive surface so as to at least partially overlap said first and second contact areas and define an electrically conductive path between said contact areas through the resistive oxide layer; or (d) applying by a thermal spraying process, as defined hereinbefore, a resistive oxide layer to said electrically non-conductive surface; and (e) depositing first and second contact areas onto the resistive oxide layer so as to define an electrically conductive path between said contact areas through the resistive oxide layer.

The thermally sprayed, electrically resistive layer is, in either case, preferably formed in accordance with the procedures set out in EP-A- 302589 and U.S. Pat. No. 5,039,840.

Advantageously, in the case of a metal or metallic substrate, said electrically non-conductive coating is applied to the substrate to a thickness capable of withstanding without breakdown an applied voltage between the substrate and the electrically non-conductive coating surface of at least 4000 volts.

The element contact areas are preferably deposited onto the electrically non-conductive surface in a configuration suitable to achieve maximum coverage of the substrate by the resistive oxide layer and to accept the required temperature limiting device.

The electrically non-conductive coating is preferably in the form of an enamel or a variety of metal oxides or nitrides known to have high dielectric properties, such as alumina, titania and magnesia.

The electrically non-conductive coating may be applied as an enamel, in one or more steps; or as an insulating metal oxide or combination of metal oxides. It can be deposited by thermal spraying techniques or chemical processes following, for example, the principles envisaged in the "sol gel" technique.

The thermal conductivity of the electrically non-conductive coating may be enhanced by the admixture to it of other ceramic materials, having equivalent or better dielectric properties, but with better thermal conductivities. Such ceramic materials may, for example, be the nitrides of boron or aluminium.

The contact areas are preferably applied to the electrically non-conductive surface or the resistive oxide surface by physical or chemical deposition techniques such as vacuum evaporation, magnetron sputtering, electrolysis or electroless deposition or any form of thermal spraying.

The contact areas preferably comprise a metal, or combination of metals, or other non-metal materials, known to have high electrically conductive properties, such as silver, copper aluminium, nickel and gold.

The thickness of the metal contact areas is preferably such that they will carry the maximum operating current required for the element, usually at a maximum of 15 amps.

The configuration of the contact areas is preferably such that they will provide for maximum coverage of the electrical resistive oxide layer on the dielectric and also accommodate an operating temperature limiting device, if required.

The operating temperature limiting device may be a conventional bimetallic switching type, fused link, or other thermally reactive form.

Advantageously, the resistive oxide is such that its surface is sufficiently electrically non-conductive without the addition of a further protective layer. Alternatively, or in addition, a further non-electrically conductive protective layer can be applied over the exposed surfaces of the resistive oxide and contact areas.

By use of the present method, a configuration of the resistive, thermally sprayed oxide layer can be obtained such that the current density at any point on the oxide surface is only a small fraction of the total current being carried, with the result that if contact is made to the oxide surface whilst in operation only a small leakage current escapes so that the element is safer than a conventional open wire or strip element.

The method and structure provided by the present invention renders the resulting heating element to be more convenient, by virtue of its size and shape, to handle during assembly and to give opportunity to the liquid heating appliance designed to make best use of available space and minimise production materials.

BRIEF DESCRIPTION OF THE DRAWINGS

The invention is described further hereinafter, by way of example only, with reference to the accompanying drawings, in which.

DETAILED DESCRIPTION OF THE PREFERRED EMBODIMENTS OF THE INVENTION

Figure 1:
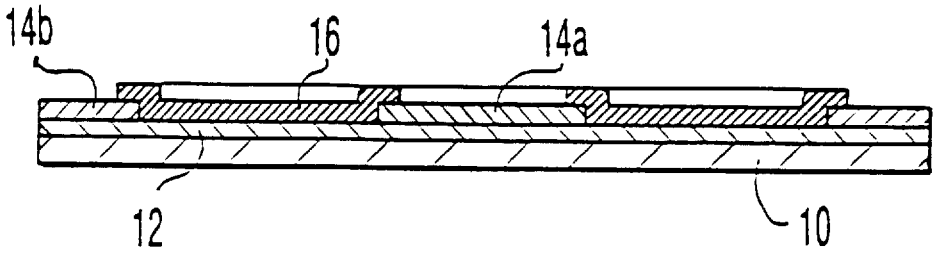
FIGS. 1 and 2 are highly schematic inverted, sectional side and plan views illustrating diagrammatically the construction of a first embodiment of an electrical resistance, liquid heating element in accordance with the present invention.
Figure 2:
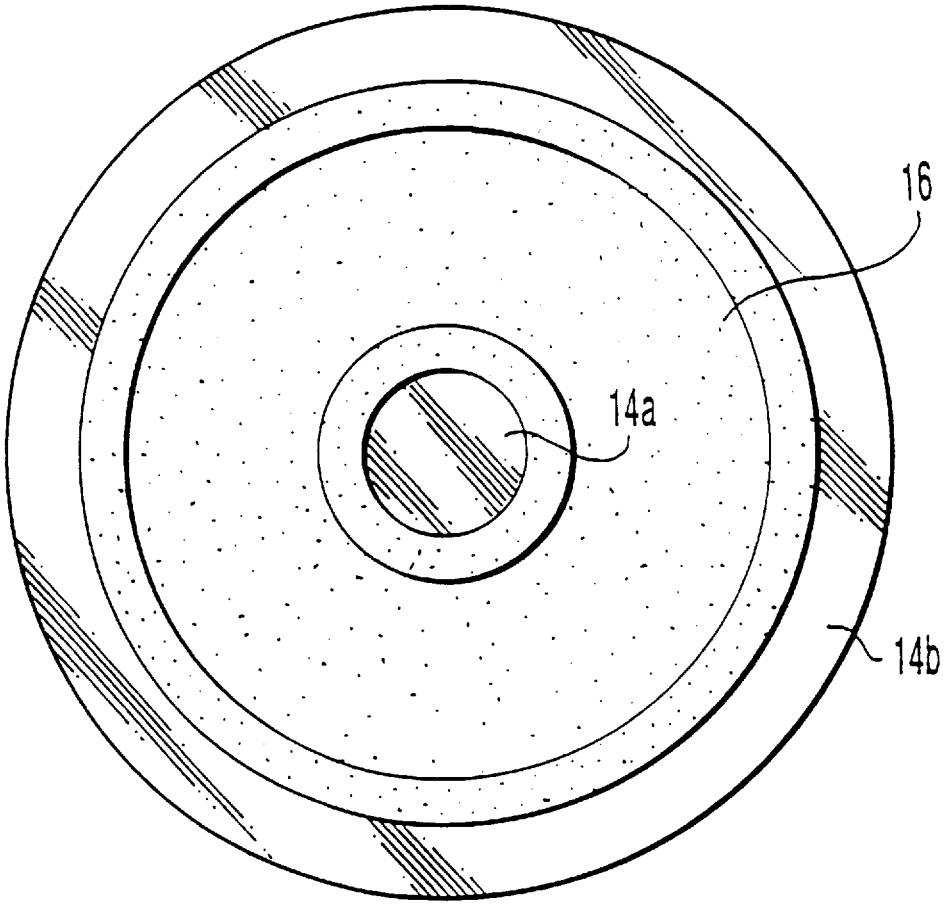

Referring first to FIGS. 1 and 2 where, for the purposes of illustration, the thickness of the various layers are exaggerated and not to scale, the first embodiment comprises a substrate 10, manufactured from metal, or other material, having good thermally conductive properties and being processed/formed into the shape required to form the bottom of a liquid heating vessel, or capable of being readily attached to the base of such vessel. In FIGS. 1 and 2, the substrate is shown as being circular but it could in principle be any desired shape.

Copper is usually preferred as the material for the substrate 10, since the coefficient of thermal heat transfer is 377 watts/meter/°Kelvin, which is well in excess of that of stainless steel at only 18 watts/meter/°Kelvin. The substrate 10 is usually produced, as a circular planar disc, of diameter suitable for attachment to, or installation in, a relevant liquid heating vessel. The substrate disc may be completely flat or be profiled, for example with a flanged rim for assisting assembly with the other parts of the vessel.

To one side of the substrate 10 (the upper side as shown in the inverted view of FIG. 1 but the underside in practice) there is applied a dielectric (electrically non-conductive/insulating) layer 12, of a sufficient thickness as to be capable of withstanding, without breakdown, a prescribed voltage V between the metal substrate 10 and the outer surface of the dielectric layer 12. In a typical case the prescribed voltage V is of the order of 4000 volts.

The dielectric layer 12 may consist of a suitable vitreous enamel, typically having a thickness in the region of 100 $\mu$m in order to achieve the abovementioned voltage breakdown capability. The dielectric layer 12 can be applied in either one, or a succession of steps or it may consist of a series or combination of thermally sprayed Ametal oxides, such as alumina, titania or magnesia, again typically having a total thickness in the region of 100 $\mu$m.

The thermal conductivity of the dielectric layer 12 may be enhanced in some cases by the admixture to it of other ceramic materials, having equivalent or better dielectric properties but with better thermal conductivities. Examples of such other ceramic materials include the nitrides of boron and aluminium.

Onto the dielectric layer 12 are applied element contact areas 14. In the example of FIGS. 1 and 2, the contact areas comprise a centrally disposed, circular contact area 14*a* and a peripherally disposed, annular contact area 14*b*. These contact areas 14*a*, 14*b* are provided for the purpose to enable an electrical current to be passed through the next to be applied, electrically resistive heating element described further hereinafter.

The contact areas 14*a*, 14*b* can be applied to the dielectric layer 12 by any suitable chemical or physical deposition technique, such as vacuum deposition, magnetron sputtering, electroless deposition, screen printing or any form of thermal spraying technique. The contact areas may consist of one or a combination of those metals such as silver, gold, copper, aluminium and nickel, which are known to have excellent electrical conducting properties. The thickness of the metal contact areas need only be such as is required to carry the operating current of the liquid heating element described hereinafter, which is usually up to a typical maximum of 15 amps but could in practice be much higher.

The size and configuration of the contact areas 14*a*, 14*b* are established such that they will, if necessary accommodate an operating temperature limiting device (not shown), as is described further in connection with the practical embodiments of FIGS. 3 and 4, and 5 and 6.

An electrically resistive element 16 is now applied to the exposed surface of the dielectric layer 12 so as to cover the area between the two contact areas 14*a*, 14*b* and to overlap these contact areas at least partially.

The resistive material making up the resistive element 16 consists of a powdered metal oxide or oxides, which is applied by thermal spraying and preferably by the flame spraying process described and claimed in EP-A- 302589 and U.S. Pat. No. 5,039,840.

The parameters for the flame spray process are set to produce a metal oxide deposit having a resistivity which is typically in the region of 14 ohm mms, at which level the sprayed resistive oxide deposit in the configuration of FIGS. 1 and 2 will have a requisite thickness capable of working at a typical current density level in the region of 0.8 to 1.0 amps per $mm^2$.

Using the procedure of the above quoted patents, to which reference is hereby directed, the resistive element 16 can be formed in a plurality of passes to achieve resistive elements with a variety of deposit thicknesses, for example so that the resulting resistances give element power outputs ranging from 1.5 to 3.0 kilowatts, using an applied voltage of 230/240 volts. Other embodiments might have, for example, deposit resistivity and thickness to produce elements of the same general configuration but capable of producing power outputs ranging from 0.75 to 1.5 kilowatts, using an applied voltage of 110/120 volts.

Figure 3:
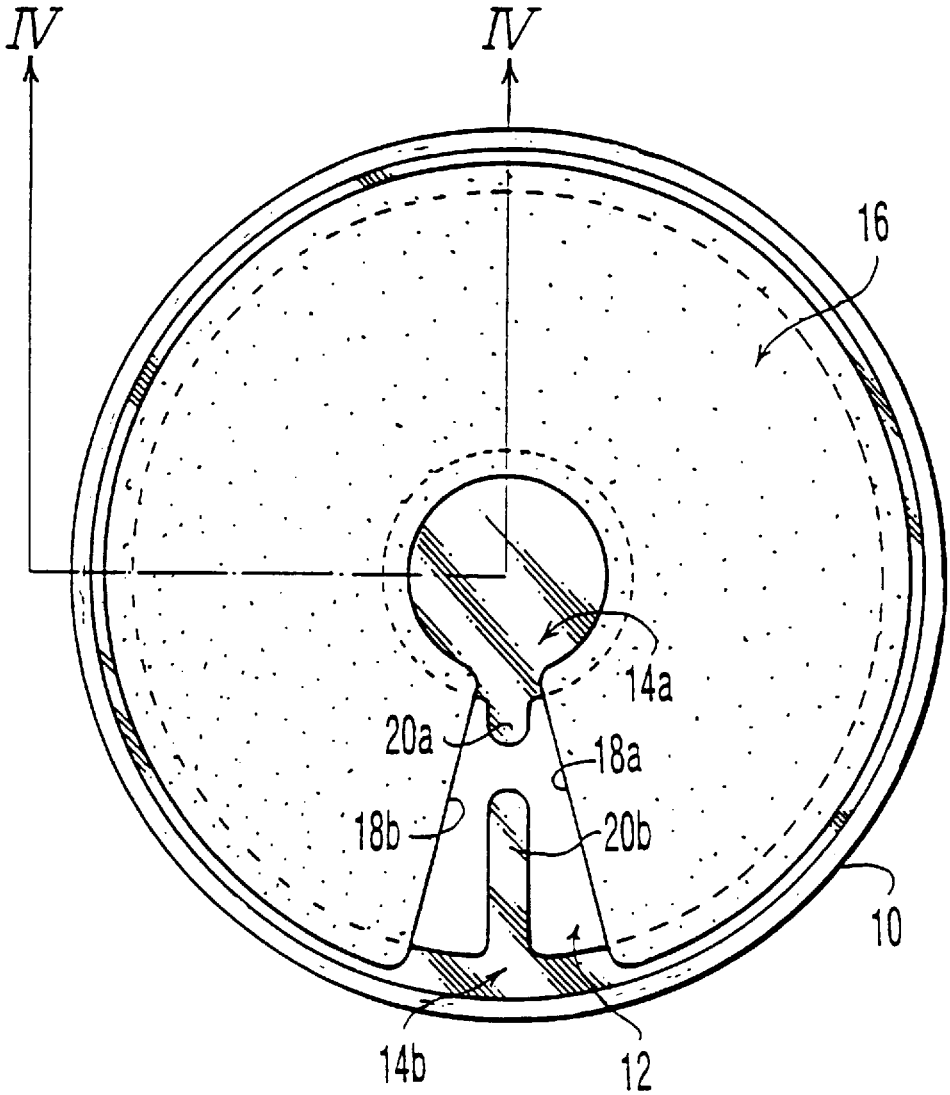
FIG. 3 is a diagrammatic plan view of a practical version of the embodiment of FIG. 1.
Figure 4:
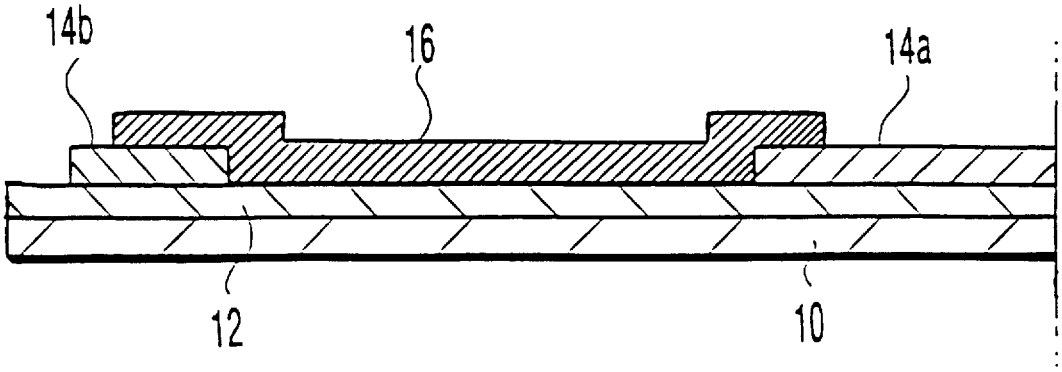
FIG. 4 is a sectional side view of the embodiment of FIG. 3, taken on the line A—A in FIG. 3.

Reference is now directed to FIGS. 3 and 4 which show diagrammatically a practical embodiment similar to that of FIGS. 1 and 2. The same reference numerals are used in FIGS. 3 and 4 for corresponding components appearing in FIGS. 1 and 2. Thus, this embodiment also employs a circular metal disc substrate 10, a dielectric layer 12, a circular inner contact area 14*a*, an annular outer contact area 14*b* and a generally annular resistive oxide layer 16. However, as best seen in FIG. 3, in this embodiment, in order to accommodate the inclusion of a (conventional) temperature limiting device (not shown), the otherwise annular resistive oxide layer includes an angular discontinuity between side regions 18*a*, 18*b* where the dielectric layer 12 is exposed. The contact areas 14*a*, 14*b* have respective integral tongue portions 20*a*, 20*b* which project radially outwardly and radially inwardly over the exposed region of the dielectric layer 12 whereby to provide mounting locations to which respective terminals of the temperature limiting device can be attached. For example by soldering, brazing or the like. The temperature limiting device acts as a switch which normally serves to supply the electrical current from the main supply to the resistive heating element 16 but which cuts off said supply automatically if the ambient temperature around the limiting device exceeds a preset level. It can be, for example, of a conventional bimetallic type, fused link or other thermally reactive form.

The size and configuration of the contact areas 14*a*, 14*b* are selected such that they will accommodate the operating temperature limiting device and also allow for maximum possible coverage of the dielectric layer by the electrical resistive layer 16.

In practical use, the device is of course inverted from the position shown in FIG. 4 so that the substrate can form, or be attached to, the base of a liquid heating vessel. The temperature limiting device is thus normally accommodated beneath the heating element itself in a bottom chamber of the vessel.

Figure 5:
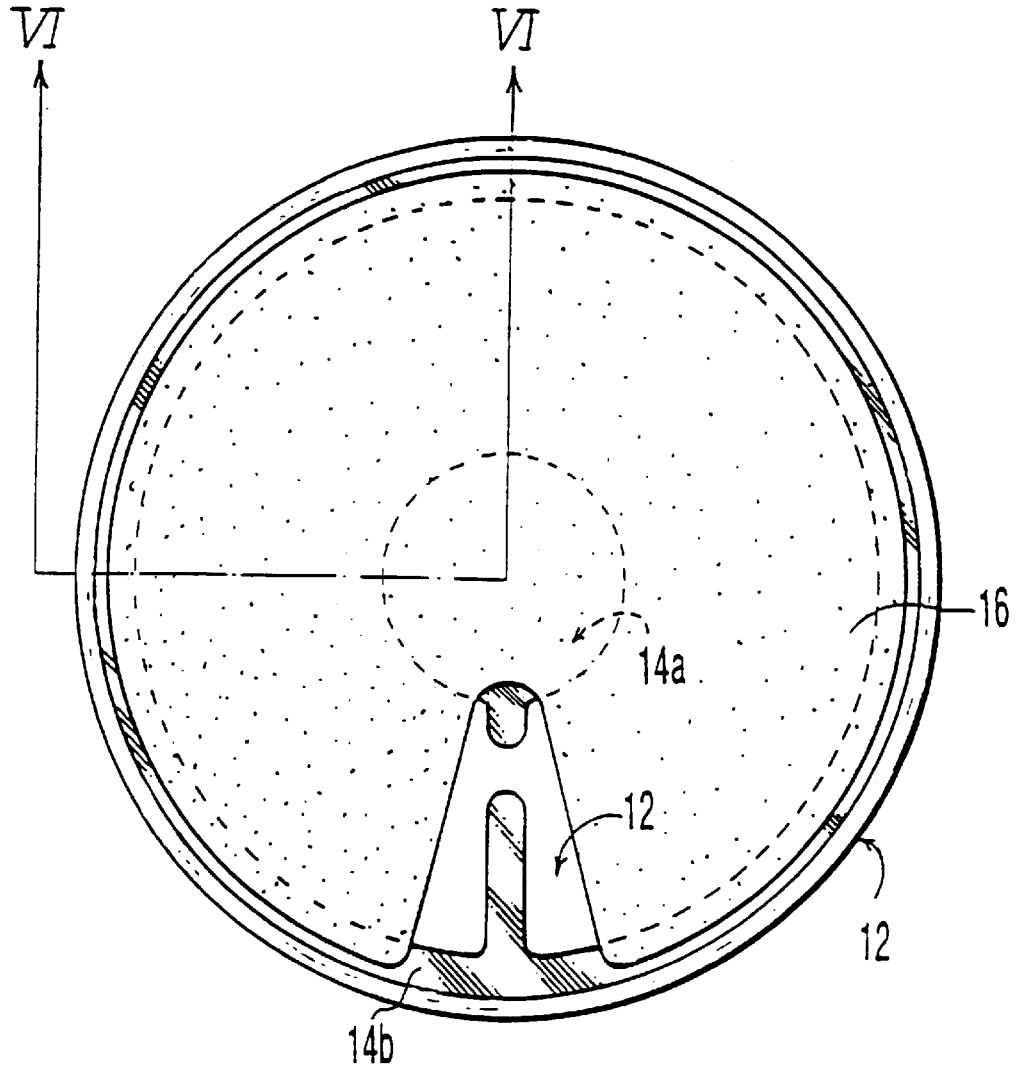
FIGS. 5 and 6 are diagrammatic plan and sectional side views of a second embodiment in accordance with the invention.
Figure 6:
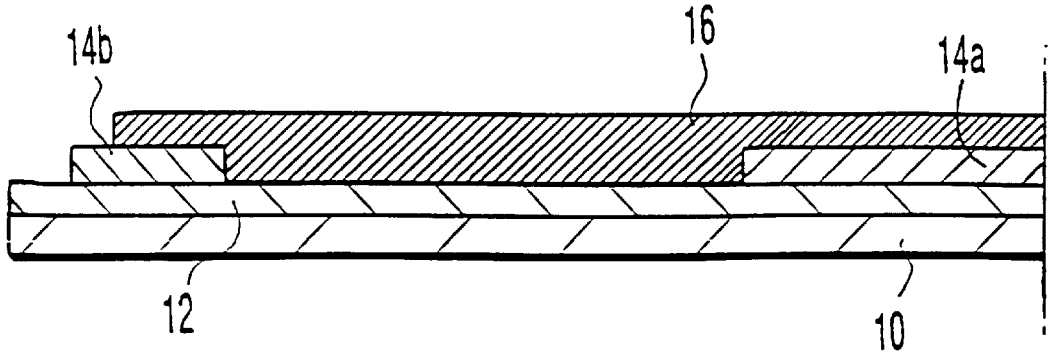

The embodiment of FIGS. 5 and 6 is the same as that of FIGS. 3 and 4 except only that (a) the resistive oxide layer, constituting the heat generating part of the element, is continued under the whole of the inner contact area 14*a* so as to be substantially circular as compared to the generally annular format of the resistive layer in FIGS. 3 and 4, and (b) the contact area 14*a* can be of smaller diameter than in FIGS. 3 and 4. It has been found that at least some current flows through the central part of the resistive oxide layer in this configuration to provide a corresponding heating effect, even though it is fully covered by the contact element 14*a*.

Figure 7:
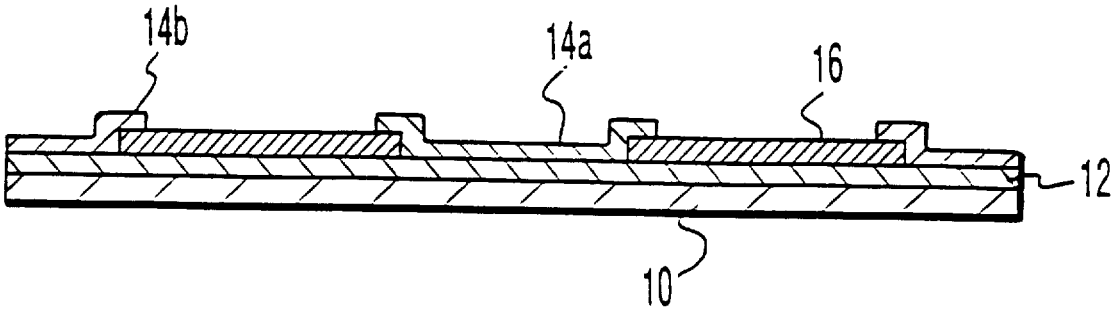
FIGS. 7 and 8 are diagrammatic sectional side views of third and further embodiments.
Figure 8:
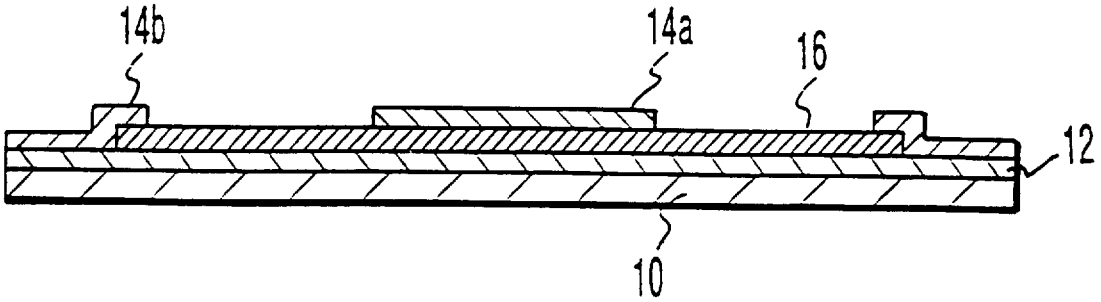

Whereas in the illustrated embodiments of FIGS. 1 to 6 it is evident that the contact areas 14*a*, 14*b* are laid first and then at least partially overlaid by the resistive oxide layer 16, in other embodiments this can be reversed in that the resistive oxide layer 16 can be laid down first and the contact areas 14*a*, 14*b* then laid so as to at least partially overlap the resistive oxide. Thus, in the embodiment of FIG. 7, an annular resistive oxide layer 16 is applied to the dielectric layer 12 first and then inner and outer contact areas 14*a*, 14*b* are applied. Likewise in FIG. 8, a circular region of resistive oxide 16 is applied first and then followed by a circular inner contact area 14*a* and annular outer contact area 14 are then applied. When viewed in plan these latter embodiments would again need to incorporate the angular discontinuity shown in FIGS. 3 and 5 in the resistive oxide layer in order to accommodate the temperature limiting device.

A number of practical advantages result from this type of thick film resistive liquid heating element, which can be summarised as follows. (1) As may be seen from FIGS. 1, 3 and 5, the current flows radially from the outer contact ring 14*b* to the inner 14*a*, or vice versa. The current is not therefore constrained to flow along any particular track as in the case of prior elements comprising printed circuit conductive tracks. One benefit arising from this is that local damage to the element need not deleteriously affect the element operation. The current simply increases its density of flow around the local damage. In this respect, the element may be considered to be "adaptive", in that the configuration allows the current flow to adapt itself to variations within the resistive layer. This "adaptive" property is of considerable consequence in enhancing the life of the element and its ability to withstand localised damage without failure. Conventional discretely tracked elements do not have this adaptive capability.

(2) From consideration of the element configuration and sizes shown in FIG. 5, it will be noted that the electrically resistive deposit 16 covers approximately 86% of the total substrate area. This is a much greater degree of coverage than can be achieved by either the conventional printed circuit conductive track heating element, or the sheathed element combined with metal plate. The heat energy being generated therefore has a much greater area over which it can be transmitted to the liquid being heated, with the result that the element will operate at a lower temperature than the two conventional types mentioned above. This reduced operating temperature allows this new type of element to be used more easily with the low melting point polymer materials, currently used in the production of liquid heating devices.

(3) The elements provided by the present invention can be lighter and therefore of lower thermal mass than flat plate sheathed elements, or thick film printed circuit type elements. For example, a conventional 2 kW flat plate sheathed element weighs in the region of 225/230 grammes, and an equivalent output capacity printed circuit element of the order of 110 grammes whereas a 2.5 kW thick film sprayed element of this present invention may have a weight typically in the region of 95 grammes. This difference in weight affects the operational efficiency in so much as less energy is required initially to raise the element to the required operating temperature for the lighter elements.

(4) The thermally sprayed elements of the present invention can be produced by a fully automated process, requiring only two/three simple steps (not necessarily in this order): application of the electrically non-conductive layer 12 to the metal substrate 10 (if a metal substrate is used); deposition of the high conductivity metal contact areas 14*a*, 14*b*; and deposition by thermal spraying of the electrically resistive area 16. Each step of the production process is controllable within fine tolerances.

(5) A further advantage of elements in accordance with the present invention is that they have a lower electromagnetic signature than conventional tracked elements. The reason for this probably lies in the short radial current path and large cross sectional area, which allow the electron concentration which builds up at the point of switching off power, to be more easily dissipated.

I claim:

1. An electrically resistive heating element for liquids, comprising a substrate (10) formed of an electrically insulating material or formed of an electrically conductive material provided with an electrically insulating coating, whereby in both cases the substrate (10) presents an electrically non-conductive surface (12) on at least one side, first and second laterally spaced contact areas (14*a*, 14*b*) disposed over said electrically non-conductive surface (12) and a thermally sprayed resistive oxide layer (16) applied to at least part of said electrically non-conductive surface (12) and disposed over or under at least parts of said contact areas (14*a*, 14*b*) to enable an electric current to be passed through the resistive oxide layer (16) via said first and second contact areas (14*a*, 14*b*).

2. A heating element as claimed in claim 1, wherein the substrate (10) is discoidal and the resistive oxide layer (16)

is basically circular or annular but contains an angular discontinuity for accommodating a temperature limiting device.

3. A heating element as claimed in claim 2, wherein said first and second contact areas (14*a*, 14*b*) are disposed centrally and peripherally of the discoidal substrate (10), respectively, and include respective tongue portions (20*a*, 20*b*) projecting into said discontinuity in the resistive oxide layer for forming terminal areas to receive said temperature limiting device.

4. A heating element as claimed in claim 2, wherein the central contact area (14*a*) is circular and the peripheral contact area (14*b*) is annular, and the resistive oxide layer (16) is applied to said electrically non-conductive surface so as to at least partially overlap said contact areas (14*a*, 14*b*).

5. A heating element as claimed in claim 1, wherein the resistive oxide layer (16) is annular and is applied directly to said electrically non-conductive surface (12), the central contact area (14*a*) being circular and overlapping the inner periphery of the annular resistive oxide layer (16), and the peripheral contact area (14*b*) being annular and overlapping the outer periphery of the annular resistive oxide layer (16).

6. A heating element as claimed in claim 1, wherein the resistive oxide layer (16) is circular and is applied directly to said electrically non-conductive surface (12), the central contact area (14*a*) is circular and is disposed over the resistive oxide layer (16) and the peripheral contact area (14*b*) is annular and at least partially overlaps the outer periphery of the resistive oxide layer (16).

7. A heating element as claimed in claim 1, fitted with a temperature limiting device.

8. A method of forming an electrically resistive heating element for liquids, comprising the steps of:

(a) forming a substrate (10) of an electrically insulating material or of an electrically conductive material provided with an electrically non-conductive coating, whereby, in each case, the substrate (10) presents an electrically non-conductive surface (12) on at least one side; and either (b) depositing first and second contact areas (14*a*, 14*b*) onto said electrically non-conductive surface (12); and (c) applying by a thermal spraying process as defined hereinbefore, a resistive oxide layer (16) to the exposed part of said electrically non-conductive surface (12) so as to at least partially overlap said first and second contact areas (14*a*, 14*b*) and define an electrically conductive path between said contact areas (14*a*, 14*b*) through the resistive oxide layer (16); or (d) applying by a thermal spraying process, as defined hereinbefore, a resistive oxide layer (16) to said electrically non-conductive surface (12); and (e) depositing first and second contact areas (14*a*, 14*b*) onto the resistive oxide layer (16) so as to define an electrically conductive path between said contact areas (14*a*, 14*b*) through the resistive oxide layer (16).

9. A method as claimed in claim 8, wherein, in the case of a metal or metallic substrate, said electrically non-conductive coating is applied to the substrate to a thickness capable of withstanding without breakdown an applied voltage between the substrate and the electrically non-conductive coating surface (12) of at least 4000 volts.

10. A method as claimed in claim 8, wherein the element contact areas (14*a*, 14*b*) are deposited onto the electrically non-conductive surface (12) in a configuration to achieve maximum coverage of the substrate (10) by the resistive oxide layer (16) and to accept the required temperature limiting device.

11. A method as claimed in claim 8, wherein the electrically non-conductive coating (12) is in the form of an enamel or a variety of metal oxides or nitrides known to have high dielectric properties, such as alumina, titania and magnesia.

12. A method as claimed in claim 8 wherein the electrically non-conductive coating (12) is applied as an enamel, in one or more steps, or as an insulating metal oxide or combination of metal oxides.

13. A method as claimed in claim 12, wherein the electrically non-conductive coating (12) is deposited by a thermal spraying technique.

14. A method as claimed in claim 12, wherein the electrically non-conductive coating (12) is deposited by a chemical process based on the "sol gel" technique.

15. A method as claimed in claim 8, wherein the thermal conductivity of the electrically non-conductive coating (12) is enhanced by the admixture to it of other ceramic materials, having equivalent or better dielectric properties, but with better thermal conductivities.

16. A method as claimed in claim 15, wherein said other ceramic materials are nitrides of boron or aluminium.

17. A method as claimed in claim 8 wherein the contact areas (14*a*, 14*b*) are applied to the electrically non-conductive surface (12) or the resistive oxide surface (16) by physical or chemical deposition techniques, including vacuum evaporation, magnetron sputtering, electrolysis or electroless deposition or thermal spraying.

18. A method as claimed in claim 8 wherein the contact areas (14*a*, 14*b*) comprise a metal, or combination of metals, or other non-metal materials, known to have high electrically conductive properties.

19. A method as claimed in claim 18, wherein said metals include any of silver, copper, aluminium, nickel and gold.

20. A method as claimed in claim 18, wherein the thickness of the metal contact areas (14*a*, 14*b*) is such that they will carry the maximum operating current required for the element.

21. A method as claimed in claim 8, wherein the configuration of the contact areas (14*a*, 14*b*) is such that they will provide for maximum coverage of the electrical resistive oxide layer (16) on the dielectric and also accommodate an operating temperature limiting device.

22. A method as claimed in claim 21, wherein the operating temperature limiting device is a conventional bimetallic switching type, fused link, or other thermally reactive form.

23. A method as claimed in claim 8, wherein the resistive oxide is such that its surface (16) is sufficiently electrically non-conductive without the addition of a further protective layer.

24. A method as claimed in claim 8, wherein alternatively, or in addition, a further non-electrically conductive protective layer can be applied over the exposed surfaces of the resistive oxide and contact areas.

* * * * *